US006695656B2

(12) United States Patent
Fuse et al.

(10) Patent No.: US 6,695,656 B2
(45) Date of Patent: Feb. 24, 2004

(54) DRIVE SHAFT SUPPORT STRUCTURE FOR SMALL WATERCRAFT

(75) Inventors: Tomohiro Fuse, Saitama (JP); Masahiko Tsuchiya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/213,069

(22) Filed: Aug. 7, 2002

(65) Prior Publication Data

US 2003/0049980 A1 Mar. 13, 2003

(30) Foreign Application Priority Data

Sep. 7, 2001 (JP) ..... 2001-272361

(51) Int. Cl.[7] ..... B63H 23/34
(52) U.S. Cl. ..... 440/83; 440/38; 440/112
(58) Field of Search ..... 440/38, 82, 83, 440/112; 277/585; 384/215

(56) References Cited

U.S. PATENT DOCUMENTS 3,993,015 A * 11/1976 Klepacz et al. ..... 440/41
4,722,707 A * 2/1988 Murase ..... 440/38
4,765,075 A * 8/1988 Nakase et al. ..... 440/38
4,861,294 A * 8/1989 Ousley, II ..... 440/83
5,224,887 A * 7/1993 Futaki ..... 440/46
5,372,526 A * 12/1994 Ozawa et al. ..... 440/38
5,618,213 A * 4/1997 Nanami ..... 440/38
5,730,633 A * 3/1998 Henmi et al. ..... 440/112
5,749,757 A * 5/1998 Suganuma ..... 440/83

* cited by examiner

*Primary Examiner*—S. Joseph Morano
*Assistant Examiner*—Andrew Wright
(74) *Attorney, Agent, or Firm*—Birch, Stewart, Kolasch & Birch, LLP

(57) ABSTRACT

A drive shaft support structure for a boat for preventing water from penetrating a boat body via a cylindrical portion through which the drive shaft passes. The cylindrical portion extends inwardly from outside the boat toward the engine. A support portion for supports a rubber dampered bearing body, which rotatably supports the drive shaft on the engine side. The rubber dampered bearing body includes a rubber damper portion and a rubber cylindrical portion formed integrally with the rubber damper portion and extending toward the cylindrical portion. The rubber cylindrical portion and the cylindrical portion are directly connected. The rubber dampered bearing body supports the rear end of a cover for a coupler for connecting an output shaft of the engine and the drive shaft.

18 Claims, 7 Drawing Sheets

DRIVE SHAFT SUPPORT STRUCTURE FOR SMALL WATERCRAFT

CROSS-REFERENCE TO RELATED APPLICATION

The present application claims priority under 35 U.S.C. §119 to Japanese Patent Application No. 2001-272361, filed Sep. 7, 2001, the entire contents of which are hereby incorporated by reference.

BACKGROUND OF THE INVENTION

1. Field of the Invention

The present invention relates to a drive shaft support structure for a small watercraft. More particularly, the present invention relates to a drive shaft support structure for a small watercraft in which an impeller is driven by a drive shaft connected to an output shaft of an engine mounted in a boat body.

2. Description of Background Art

A conventional drive shaft support structure for a small watercraft is shown in FIG. 7.

FIG. 7 shows an engine 1 mounted on a boat body 2, and a drive shaft (hereinafter referred also to simply as a shaft) 4 connected to an output shaft 1*a* of the engine 1 through a coupler 3. An impeller 5*a* of a jet pump 5 is fixed to the rear end of a shaft 4. When the impeller 5*a* is rotationally driven by the engine 1 through the shaft 4, water is taken in through a water intake port 2*a* provided at the bottom of the boat and is jetted from a nozzle 5*b*, whereby the boat is propelled forward.

The boat body 2 is provided with a cylindrical portion 2*b* through which the shaft 4 passes and which extends from the outside of the boat toward the engine 1, and a support portion 2*c* for supporting a rubber dampered bearing body 6 rotatably supporting the shaft 4 on the engine 1 side.

The bearing body 6 includes a metallic cylindrical member 6*a*, a bearing member 6*b* mounted in the cylindrical member 6*a*, a rubber damper portion 6*c* formed integrally with the outer circumference of the bearing body 6, and a reinforcement member 6*d* integral with the rubber damper portion 6*c*. The bearing body 6 is fixed to the support portion 2*c* by passing a bolt 6*e* through the reinforcement member 6*d*, mating a nut 6*f* to the bolt 6*e*, and fastening the nut 6*f*.

A tubular body 7 is disposed in an intermediate position between the bearing body 6 and the support portion 2*c*. The tubular body 7 includes a tubular portion 7*a* extending toward the tubular portion 2*b* of the boat body 2 and a flange portion 7*b*. The tubular body 7 is fixed to the support portion 2*c* by fastening the flange portion 7*b* to the bearing body 6 with a bolt 6*e* and nut 6*f*.

The rear end of the tubular body 7 and a tip end portion of the tubular portion 2*b* of the boat body 2 are connected to each other by a rubber sleeve 8. In this condition, both ends of the rubber sleeve 8 are fastened by ring-shaped clamps 9, 9.

According to this conventional shaft support structure, the shaft 4 can be rotatably supported by the rubber dampered bearing body 6 to absorb some of the oscillation of the shaft 4.

While some penetration of water W inside the boat body 2 can be prevented through the tubular portion 2*b* of the boat body 2 can be prevented to a certain degree by the rubber sleeve 8, the tubular body 7, and the rubber dampered bearing body 6, it is difficult to ensure. More specifically, with this conventional structure, water W tends to penetrate into the boat body 2 through the tubular portion 2*b* at one or more of the following points:

- the connection portion C1 between the tubular portion 2*b* and a rear end portion of the rubber sleeve 8;
- the connection portion C2 between a tip end portion of the rubber sleeve 8 and a tip end portion of the tubular body 7;
- the joint portion C3 between the flange portion 7*b* of the tubular body 7 and the bearing body 6; and
- the joint portion C4 between the flange portion 7*b* of the tubular body 7 and the support portion 2*c*.

In summary, it has been difficult to ensure that water will not penetrate the boat body 2. Even if the flange portion 7*b* of the tubular body 7 and the support portion 2*c* are tightly joined to each other with an adhesive, water is still likely to penetrate at least the three portions C1 to C3.

SUMMARY AND OBJECTS OF THE INVENTION

It is an object of the present invention is to provide a drive shaft structure for small watercraft which solves the at least the above problem of water seeping into the boat body through a tubular portion of the boat body.

In order to attain the above object, the present invention provides a drive shaft support structure for small watercraft, which includes an impeller in which the drive shaft is connected to an output shaft of an engine mounted in a boat body. The boat body is provided with a cylindrical portion extending from the outside of the boat body toward the engine, through which the drive shaft passes. Also provided is a rubber dampered bearing body which rotatably supports the drive shaft on the engine side so that it does not contact the cylindrical portion. The rubber dampered bearing body is supported by a support portion, and includes a rubber damper portion and a rubber cylindrical portion which extends toward the cylindrical portion, the rubber cylindrical portion being formed integrally with the rubber damper portion. The rubber cylindrical portion and the cylindrical portion are connected directly to each other.

The rubber cylindrical portion is provided with a grease supply hole for supplying grease to a water seal portion of the rubber dampered bearing body, and a grease supply hose is connected to the grease supply hole.

An engine output shaft and the drive shaft are connected to each other through a coupler having a coupler cover, the rear end of the coupler cover being supported by the rubber damper bearing body.

The drive shaft support structure for small watercraft includes the impeller driven through the drive shaft connected to the output shaft of the engine mounted in the boat body, wherein the boat body is provided with the cylindrical portion through which a drive shaft is passed and which extends from the outside of the boat toward the engine. A support portion for supporting the rubber dampered bearing body rotatably supporting the drive shaft on the engine side from the cylindrical portion is also provided. The rubber dampered bearing body includes a rubber cylindrical portion formed integrally with the rubber damper portion of the rubber dampered bearing body, and the rubber cylindrical portion and the cylindrical portion are connected directly to each other.

As a result, water which may otherwise penetrate a conventional boat body is prevented from entering the boat interior by the present invention. This is due to the fact that the present invention includes only one point where water may possibly enter, namely, the connection portion between the rubber cylindrical portion and the cylindrical portion on the boat body side. Thus, it is more difficult for water to penetrate into the boat through the cylindrical portion of the boat body than with conventional structures.

Moreover, the rubber cylindrical portion is formed integrally with the rubber damper portion of the rubber dampered bearing body, and the rubber cylindrical portion and the cylindrical portion are connected directly to each other. As a result of this structure, the number of component parts is markedly reduced as compared with the prior art. The tubular body 7, the rubber sleeve 8, and one of the two clamps 9, 9 of the conventional boats become unnecessary, and thus the assembly tasks are reduced.

With the present invention, the rubber cylindrical portion is provided with the grease supply hole for supplying grease to the water seal portion of the rubber dampered bearing body, and the grease supply hose is connected to the grease supply hole. As a result, grease can be easily supplied to the water seal portion of the bearing body through the grease supply hose. This feature acts to prevent water from entering into the inside of the boat body through the cylindrical portion of the boat body.

Further as described above, the output shaft of the engine and the drive shaft are connected to each other through the coupler, and the coupler is provided with the coupler cover for covering the coupler. Without a cover, if water were to penetrate into the boat body it would be scattered by making contact with the coupler. This would occur if water were to penetrated the body through other portions than the connection portion between the rubber cylindrical portion and the cylindrical portion on the boat body side.

With the present invention, however, the scattering of water is prevented, since the coupler is covered by the coupler cover. In addition, since the rear end of the coupler cover is supported by the rubber dampered bearing body, a vibration-damping effect by the rubber damper is obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
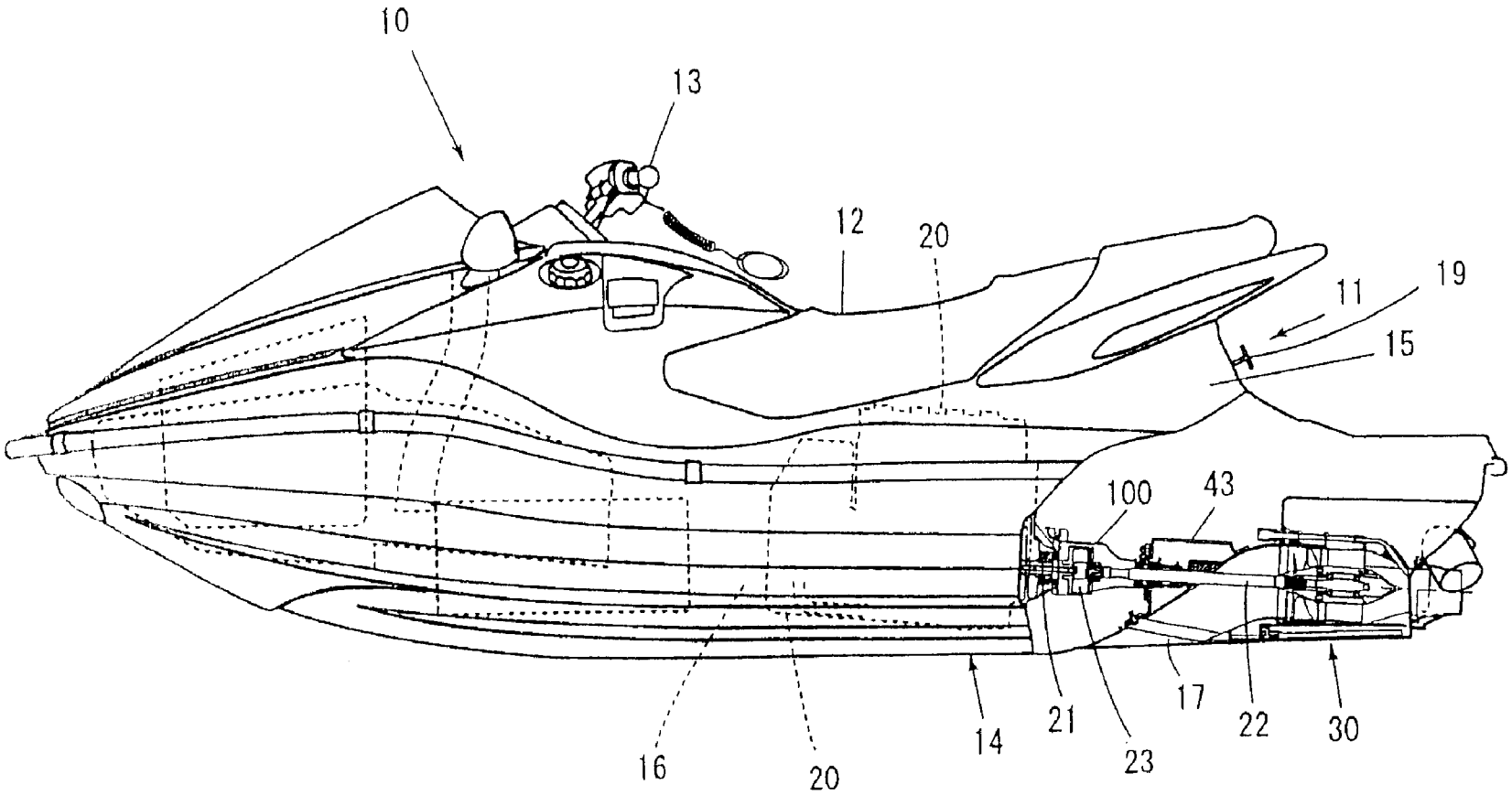
FIG. 1 is a partially cutout general side view showing one example of a personal watercraft using one embodiment of a drive shaft support structure for a small watercraft according to the present invention.

A mode for carrying out the present invention will be described below referring to the drawings.

Figure 2:
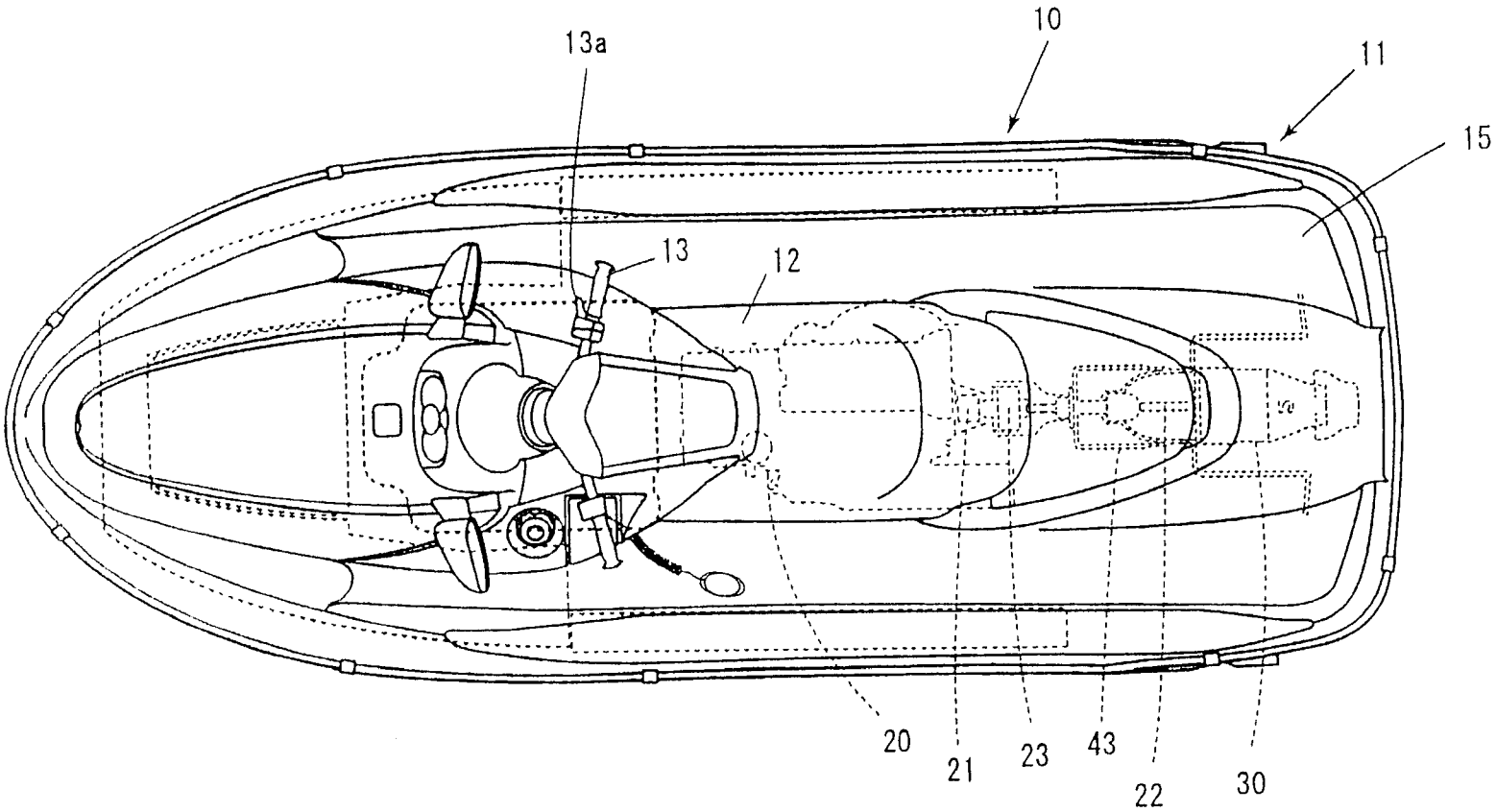
FIG. 2 is a general plan view of the same.

As shown in FIGS. 1 and 2, the personal watercraft 10 is a saddle ride type small watercraft, a passenger is seated on a seat 12 on a boat body 11, and the boat can be operated by gripping a rudder handle 13 provided with a throttle lever.

The boat body 11 is a buoyancy structure in which a hull 14 and a deck 15 are jointed to each other to form a space 16 inside. In the inside of the space 16, an engine 20 is mounted on the hull 14, and a jet pump (jet propulsion pump) 30 as propelling means driven by the engine 20 is provided at a rear portion of the hull 14.

The jet pump 30 (See FIG. 3) includes an impeller 32 disposed in a conduit 18 extending from a water intake port 17 opening at the bottom of the boat to a nozzle port 31*c*2 opening at the rear end of the boat body and a deflector 38, and a driving shaft (drive shaft) 22 for the impeller 32 is connected to an output shaft 21 (See FIGS. 1 and 4) of the engine 20 through a coupler 23. Therefore, when the impeller 32 is rotationally driven by the engine 20, water taken in through the water intake port 17 is jetted from the nozzle port 31*c*2 through the deflector 38, and the boat body 11 is propelled forward. The driving rotational frequency of the engine 20, namely, the propulsion force of the jet pump 30 is operated by a turning operation of a throttle lever 13*a* (See FIG. 2) of the operating handle 13. The deflector 38 is connected to the operating handle 13 by an operating wire not shown, and is turned by the operation of the handle 13, whereby the course of the boat body 11 can be changed.

FIG. 1 shows a towing hook 19 fixed to a rear portion of the boat body 11, for towing a rubber boat, or the like.

Figure 3:
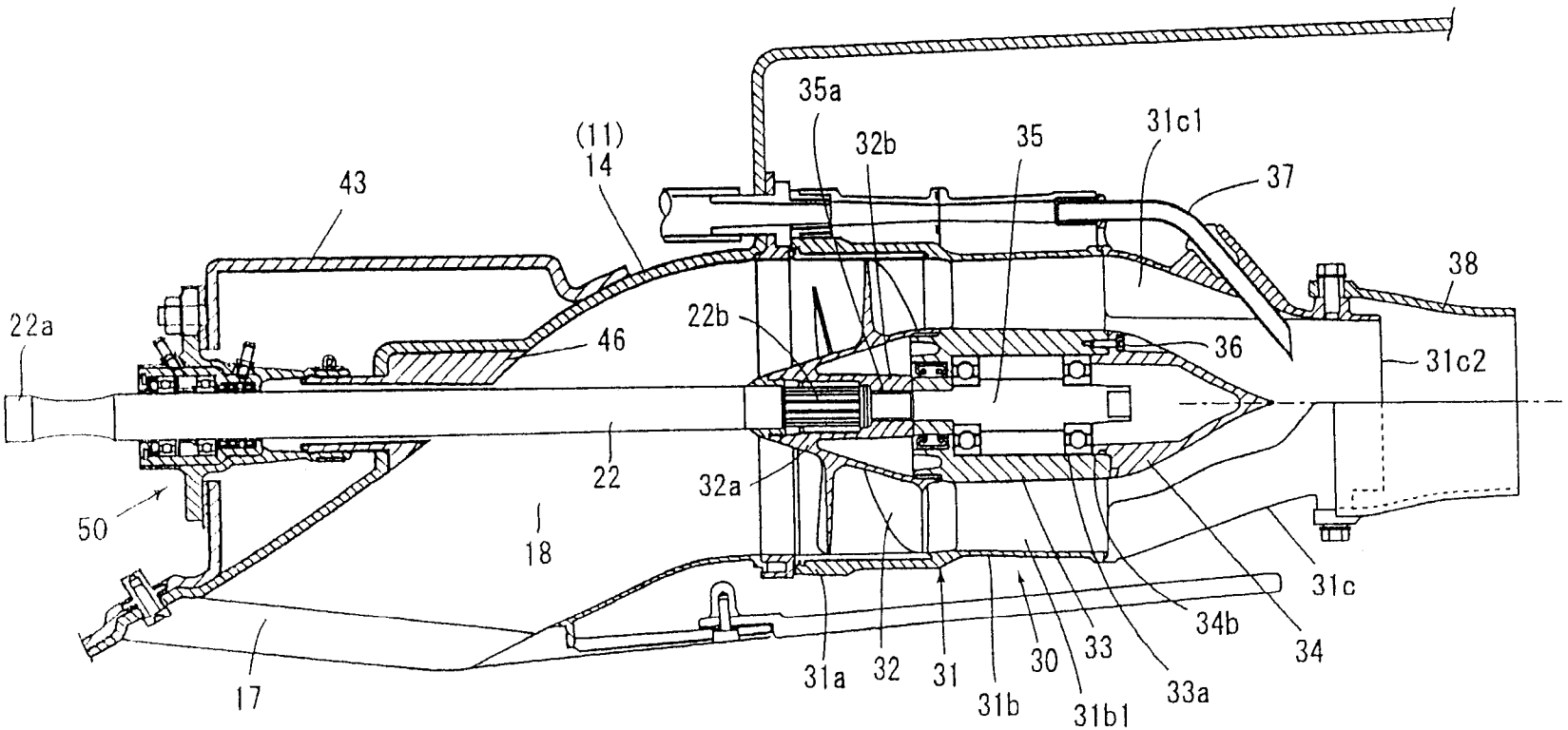
FIG. 3 is a sectional view showing mainly a jet pump 30 and a support structure for a shaft 22.
Figure 4:
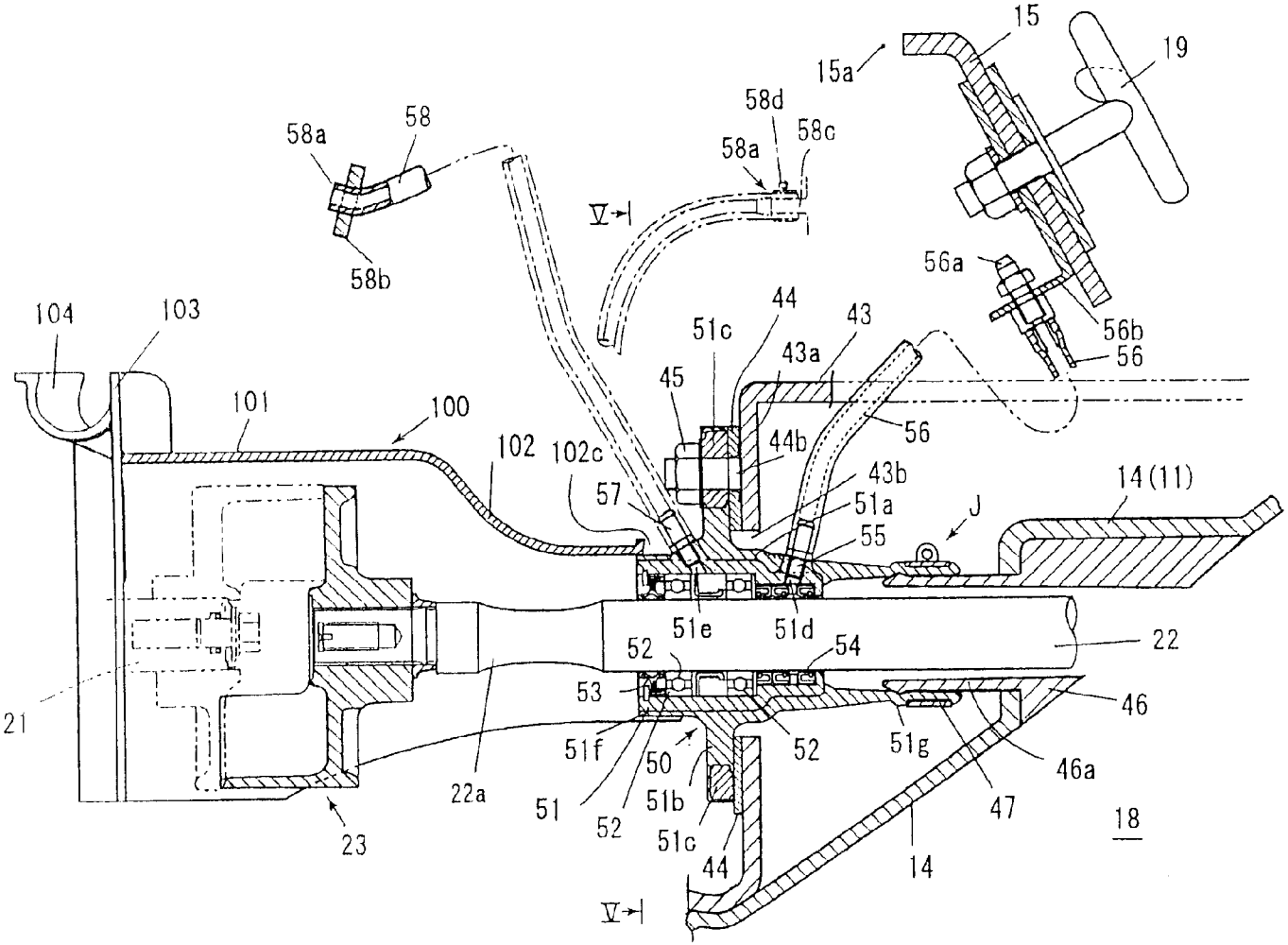
FIG. 4 is a partial enlarged view of FIG. 3, also showing a coupler cover 100 at the same time.
Figure 5:
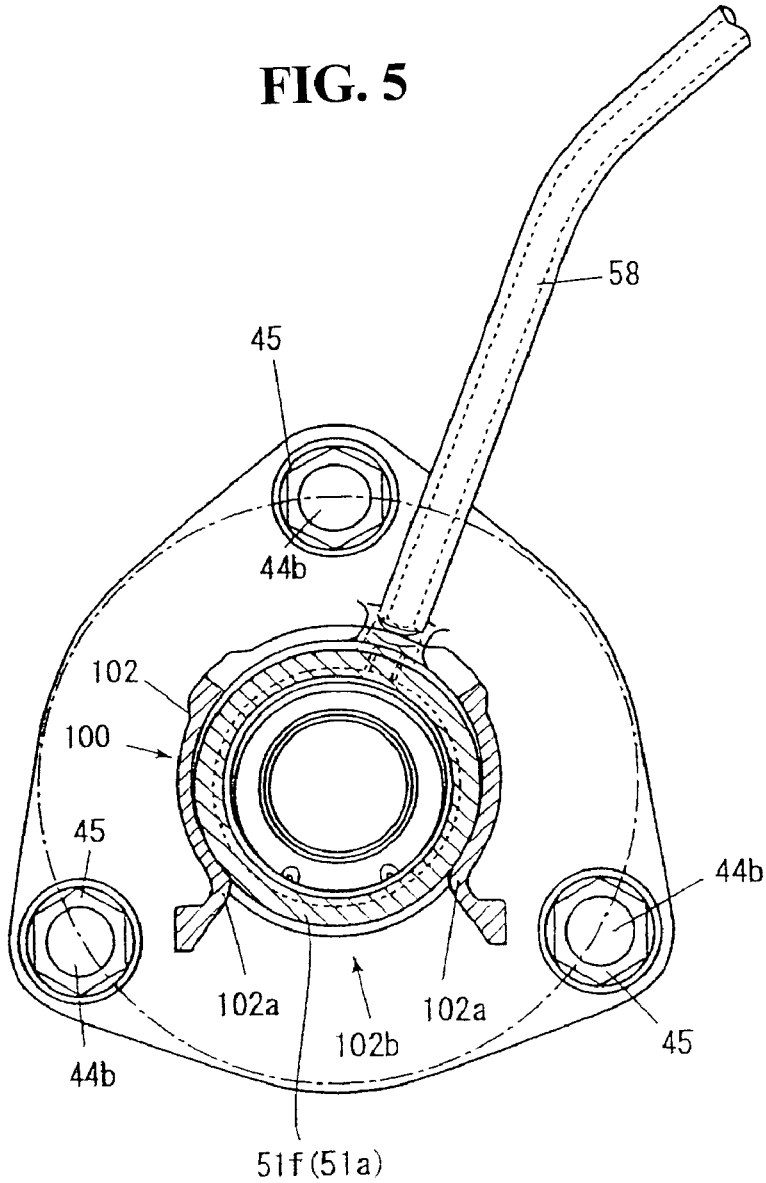
FIG. 5 is a sectional view taken along V—V of FIG. 4.
Figure 6A:
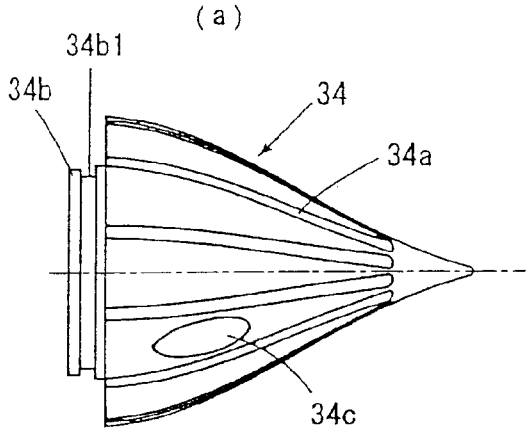
FIGS. 6(*a*)–(*c*) are illustrations of a cap 34, in which FIG. 6(*a*) is a side view, FIG. 6(*b*) is a right side view (view from the rear side of the boat body), FIG. 6(*c*) is a sectional view taken along c—c of FIG. 6(*b*), and FIG. 6(*d*) is a sectional view taken along d—d of FIG. 6(*b*)
Figure 6B:
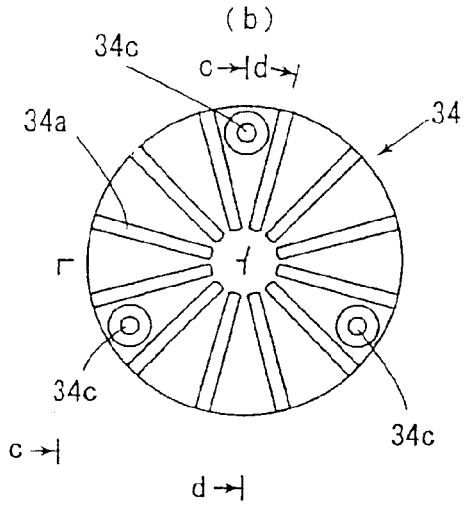
Figure 6C:
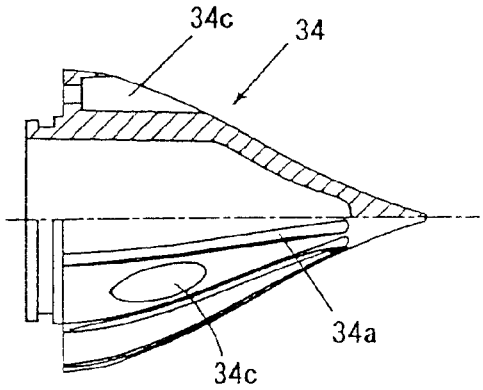
Figure 6D:
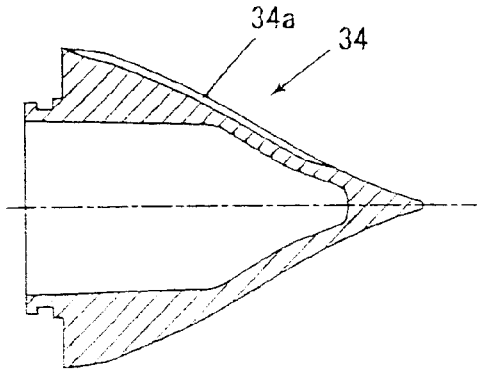

FIG. 3 is a sectional view showing mainly the jet pump 30 and the support structure of the shaft 22, FIG. 4 is a partial enlarged view of FIG. 3 showing also a coupler cover 100 at the same time, and FIG. 5 is a sectional view taken along V—V of FIG. 4.

As shown in FIG. 3, the jet pump 30 includes a duct 31 forming the conduit 28 communicating with the water intake port 17 provided at a bottom portion of the boat body 11. Impeller 32 is disposed in the duct 31, a bearing portion 33 of the impeller is provided in the duct 31, and a cap 34 is provided for closing the rear end of the bearing portion 33.

The duct 31 includes an impeller containing portion 31*a*, a bearing containing portion 31*b*, and a nozzle portion 31*c*, in which the impeller containing portion 31*a* and the bearing containing portion 31*b* are formed as one body with each other. The bearing portion 33 is integrally formed in the bearing containing portion 31*b* through a stationary vane 31*b*1.

On a front portion of the impeller 32, a boss portion 32*a* is engaged with a spline 22*b* formed at the rear end of the shaft 22. The impeller 32 is rotated together with the shaft 22. A tip end portion 22*a* of the shaft 22 is connected to the output shaft 21 of the engine 20 mounted on the boat body 11 through the coupler 23.

On the other hand, a support shaft 35 for supporting a rear portion 32*b* of the boss portion 32*a* of the impeller 32 is rotatably supported on the bearing portion 33 through a ball bearing 33*a*. A tip of the support shaft 35 is provided with a male screw 35*a*, which is mated with a female screw formed at a boss portion rear portion 32*b* of the impeller 32, whereby the impeller 32 and the support shaft 35 are connected.

Therefore, the boss portion 32*a* at the front portion of the impeller 32 is connected to the shaft 22, and the rear portion 32*b* of the boss portion is connected to the support shaft 35. Thus, the impeller 32 is rotated together with the shaft 22 and the support shaft 35.

FIGS. 6(*a*)–(*d*) illustrate the cap 34. FIG. 6(*a*) is a side view, FIG. 6(*b*) is a right side view (view from the rear side of the boat body), FIG. 6(*c*) is a sectional view taken along c—c of FIG. 6(*b*), and FIG. 6(*d*) is a sectional view taken along d—d of FIG. FIG. 6(*b*).

As can be seen in FIGS. 6(*a*)–(*d*), the outside circumferential surface of the cap 34 is provided with a plurality (in the structure shown, 12) of flow straightening grooves 34*a*.

A front portion of the cap 34 is provided with an insertion portion (tubular portion) 34*b* for insertion into a rear portion of the bearing portion 33. Also provided are three insertion holes 34*c* for screws (See FIG. 3) between the flow straightening grooves 34*a*. The tubular insertion portion 34*b* is provided with a fitting groove 34*b*1 for an O-ring (not shown).

Therefore, in conjunction with cap 34, the O-ring is fitted into the insertion portion 34*b*, and the insertion portion 34*b* is inserted (pressed) into a rear portion of the bearing portion 33 as shown in FIG. 3. The cap 34 is then fitted to the rear portion of the bearing portion 33 by the screw 36.

A portion facing to the cap 34, of the inside circumferential surface of the nozzle portion 31*c*, is provided with a stationary vane 31*c*1 toward the cap 34.

A bilge pipe 37 for discharging bilge water present at the bottom of the boat is inserted in the nozzle portion 31*c*.

In addition, the above-mentioned deflector 38 is turnably fit onto a rear portion of the nozzle portion 31*c*.

As shown in FIGS. 3 to 5, a bearing cover 43 constituting a support portion is fixed to the hull 14, and a rubber dampered bearing body 50 is fixed to the bearing cover 43.

The bearing body 50 includes a rubber-made main body 51 constituting a rubber damper portion, bearings 52, 52 contained in the main body 51, a seal member (oil seal) 53 mounted on the engine side from the bearing 52, and a seal member (water seal) 54 mounted on the jet pump 30 side (conduit 18 side) from the bearing 52.

The main body 51 includes a tubular portion 51*a*, and a flange portion 51*b* integral with the tubular portion 51*a*, and the bearings 52, the oil seal 53 and the water seal 54 are mounted in the tubular portion 51*a*. The tubular portion 51*a* forms a rubber cylindrical portion 51*g* elongated toward a cylindrical portion 46*a* on the boat body side, to be described later.

The flange portion 51*b* is provided integrally with a metallic reinforcement member 51*c*.

On the other hand, a front wall 43*a* of the bearing cover 43 is provided with a hole 43*b* for inserting the tubular portion 51*a* of the bearing body 50, and a metallic ring-shaped base 44 is closely adhered to the periphery of the hole 43*b* with an adhesive. A bolt 44*b* is arranged on the base 44.

Of the bearing body 50, a rubber cylindrical portion 51*g* is inserted in the hole 43*b* of the bearing cover 43, the bolt 44*b* is passed through the reinforcement member 51*c* of the flange portion 51*b*, and a nut 45 is mated to the bolt 44*b* from the inside of the boat body to fasten the flange portion 51*b* (and hence the reinforcement member 51*c* thereof). As a result, the bearing body 50 is fixed to the bearing cover 43.

The rear end of the rubber cylindrical portion 51*g* is connected by a ring-shaped clamp 47 to a cylindrical portion 46*a* of a joint rubber 46. The joint rubber 46 is fitted onto the hull 14 on the side of facing the conduit 18 by means of an adhesive.

As such, in this embodiment, the cylindrical portion extending from the outside of the boat body toward the engine 20 is composed of the cylindrical portion 46*a* of the joint rubber 46.

The tubular portion 51*a* of the bearing body 50 is provided with a grease supply hole 51*d* and a breather hole 51*e*.

A grease supply holes 56 is connected to the grease supply hole 51*d* through a connecting pipe 55, and a grease nipple 56*a* is provided at the tip end of the grease supply hose 56. The grease nipple 56*a* is fixed to the deck 15 by co-fastening with the above-mentioned towing hook 19 (See FIG. 1) by a fitting fixture 56*b*, in the vicinity of an opening 15*a* formed upon opening the seat 12.

Therefore, by opening the seat 12, grease can be easily supplied to the water seal 54 and the bearings 52 from the grease nipple 56*a* through the grease supply hose 56.

A breather hose 58 is connected to the breather hole 51*e* through a connecting pipe 57. The tip end 58*a* of the breather hose 58 is fixed to an appropriate portion of the boat body 11 (the hull 14 or the deck 15) by a fitting fixture 58*b*.

Therefore, expanded air generated in the bearing portion (in this case, in the tubular portion 51*a*) is discharged through the breather hole 51*e*, the connecting pipe 57, and the breather hose 58 into the boat body 11.

In addition, the breather hose 58 is formed of a material which is both extendable and contractible, such as a rubber tube. The opening end 58*a* of the breather tube 58 closed by fitting to a plug 58*c* provided at an appropriate portion in the boat as indicated by imaginary lines in FIG. 4, whereby penetration of water through the opening end 58*a* can be prevented. In this case, notwithstanding the end portion 58*a* is closed, the release of the grease or air in the bearing chamber into the breather hose 58 and the return thereof from the breather hose 58 are not hampered, because the breather hose 58 extends and contracts according to the inside pressure in the bearing chamber. Tiewrap 58*d* fastens the end portion 58*a* of the breather hose 58 to the plug 58*c*.

Incidentally, by forming the grease passage and the breather passage appropriately in the cylindrical portion 51*a*, the grease supply hose 56 and the breather hose 58 may be fitted reversely (namely, the grease supply hose 56 is disposed on the front side of the flange portion 51*b* and the breather hose 58 is disposed on the rear side of the flange portion 51*b*), and both of the grease supply hose 56 and the breather hose 58 may be fitted to the front side of the flange portion 51*b*. In some cases, only the grease supply hose 56 is fitted to the bearing body 50.

As shown in FIG. 1, the coupler cover 100 is fixed to a rear portion of the engine 20 by fitting the coupler cover portion 101 over the coupler 23. As shown in FIGS. 4 and 5, the shaft 22 and a front portion 51*f* of the tubular portion 51*a* of the bearing body 50 are put into the shaft cover portion 102 with a clicking action so as to pass them through a narrowed portion 102*b* of the shaft cover portion 102. This connects the shaft cover portion 102 onto the front portion 51*f* of the bearing body 50. A bolt passes (not shown)

through an insertion hole (not shown) of the flange portion 103 and fastens the coupler cover portion 101 to a rear portion of the engine 20.

Therefore, a front portion of the coupler cover 100 is fixed to the engine 20, and the rear end of the coupler cover is supported by the rubber dampered bearing body 50.

In the condition where the coupler cover 100 is thus fitted to the rear portion of the engine 20, the coupler cover 101 thereof covers the coupler 23, and the shaft cover portion 102 thereof covers a front end portion 22*a* of the shaft 22.

In addition, a shaft cover portion 102 at the rear of the coupler cover 100, is connected to the front portion 51*f* of the bearing body 50.

FIG. 4 also shows that the coupler cover 100 is provided with a pipe holding portion 104, and a piping in the boat body can be held by fitting it to the pipe holding portion 104. The piping to be held by the pipe holding portion 104 can be selected as required, and, for example, a hose for supplying cooling water from the jet pump 30 to a water jacket for the engine 20 or the like can be held.

According to the drive shaft support structure for a small watercraft as described above, the following actions or effects can be obtained.

(a) As described above, the present invention provides a support structure for the drive shaft 22 in a small watercraft including the impeller 32 driven through the drive shaft 22 connected to the output shaft 21 of the engine 20 mounted in the boat body 11. The boat body 11 is provided with the cylindrical portion 46*a* through which the drive shaft 22 is passed and which extends from the outside of the boat toward the engine 20, and the support portion 43 for supporting the rubber dampered bearing body 50. The rubber dampered bearing portion 50 rotatably supports the drive shaft 22 on the engine 20 side from the cylindrical portion 46*a*, and includes a rubber cylindrical portion 51*g* extending toward the cylindrical portion 46*a* and formed integrally with the rubber damper portion 51 of the rubber dampered bearing body 50. The rubber cylindrical portion 51*g* and the cylindrical portion 46*a* are connected directly to each other.

Therefore, the water tends to penetrate from the outside of the boat into the inside of the boat only through the cylindrical portion 46*a*, namely, the connection portion J between the rubber cylindrical portion 51*g* and the cylindrical portion 46*a* on the boat body side.

Therefore, as compared with the prior art, it is more difficult for water to penetrate into the boat body 11 through the cylindrical portion 46*a* of the boat body 11.

Figure 7:
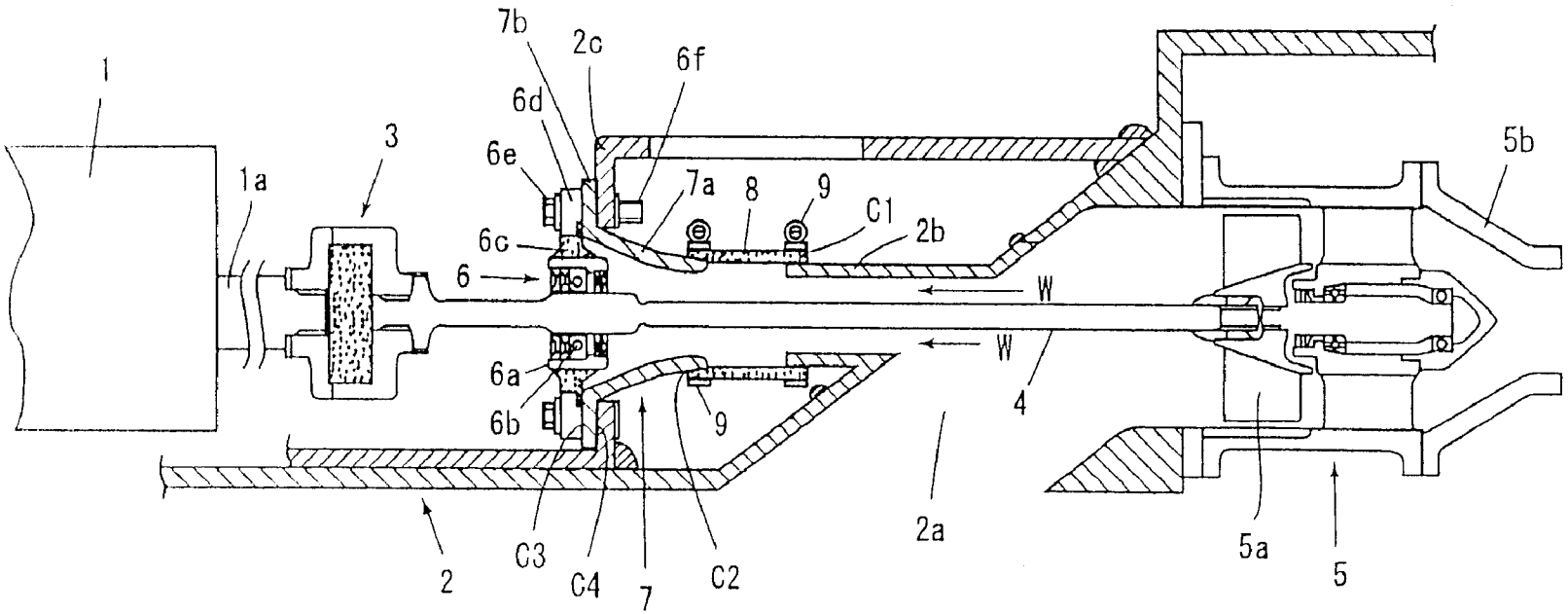
FIG. 7 PRIOR ART
FIG. 7 is an illustration of the prior art.

In addition, the rubber cylindrical portion 51*g* is formed integrally with the rubber damper portion 51 of the rubber dampered bearing body 50, and the rubber cylindrical portion 51*g* and the cylindrical portion 46*a* are connected directly to each other. As a result of this structure, the number of component parts is markedly reduced as compared with the prior art. As can be seen in FIG. 7, the tubular body 7, the rubber sleeve 8, and one of the two clamps 9, 9 in the prior art become unnecessary. As such, with the present invention, assembly is simplified.

(b) The rubber cylindrical portion 51*g* is provided with the grease supply hole 51*d* for supplying the grease to the water seal portion 54, and the grease supply hose 56 is connected to the grease supply hole 51*d*. Therefore, the grease can be easily supplied to the water seal portion 54 of the bearing body 50 through the grease supply hose 56. As a result, penetration of water into the boat body 11 through the cylindrical portion 46*a* of the boat body 11 can be prevented more favorably.

(c) The output shaft 21 of the engine 20 and the drive shaft 22 are connected to each other through the coupler 23, and the coupler 23 is provided with the coupler cover 100 for covering the coupler 23. Therefore, even if water were to penetrate into the boat 11 (for example, through a gap between the boat body 11 and the seat 12, rather than the connection portion J between the rubber cylindrical portion and the cylindrical portion on the boat body side), it would not make contact with the coupler 23, because the coupler 23 is covered by the coupler cover 100. Without the coupler cover 100 of the present invention, such water would get scattered by coming in contact with the coupler 23.

Also, since the rear end of the coupler cover 100 is supported by the rubber dampered bearing body 50, a vibration-damping effect by the rubber damper 51 can be obtained.

Therefore, since the coupler cover 100 is provided, noise due to vibration of the coupler cover 100 is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drive shaft support structure for a small watercraft having a boat body, comprising:

a drive shaft for driving an impeller, the drive shaft being connected to an output shaft of an engine mounted in the boat body;

a cylindrical portion of a joint rubber through which said drive shaft is passed, said cylindrical portion of the joint rubber extending in a forward direction from an outside of said boat body toward said engine;

a rubber dampered bearing body rotatably supporting said drive shaft on the engine side so that said drive shaft does not contact said cylindrical portion of the joint rubber; said rubber dampered bearing body being supported by a support portion;

said rubber dampered bearing body having a rubber cylindrical portion and a rubber damper portion provided integrally with said rubber cylindrical portion, said rubber cylindrical portion extending toward and overlapping around an outer side of a forward end of said cylindrical portion of the joint rubber, and said rubber cylindrical portion and the forward end of said cylindrical portion of the joint rubber being fixedly connected directly to each other.

2. The drive shaft support structure for a small watercraft as set forth in claim 1, said rubber dampered bearing body further comprising:

a plurality of bearings in the rubber damper portion;

a first seal member mounted on a side of the bearings facing the engine; and a second seal member mounted on a side of the bearings facing the impeller.

3. The drive shaft support structure for a small watercraft as set forth in claim 1, wherein a rear end of the rubber cylindrical portion is connected by a ring-shaped clamp to the cylindrical portion of the joint rubber, the joint rubber being fitted to the boat body with an adhesive.

4. The drive shaft support structure for a small watercraft as set forth in claim 1, wherein said rubber cylindrical portion is provided with a grease supply hole for supplying grease to a water seal portion of said rubber dampered bearing body, and a grease supply hose is connected to said grease supply hole.

5. The drive shaft support structure for a small watercraft as set forth in claim 4, wherein the grease supply hole is disposed on a front side of a flange portion of said rubber cylindrical portion.

6. The drive shaft support structure for a small watercraft as set forth in claim 4, wherein the grease supply hole is disposed on a rear side of a flange portion of said rubber cylindrical portion.

7. The drive shaft support structure for a small watercraft as set forth in claim 1, further comprising:

a coupler for connecting said output shaft of said engine and said drive shaft; and a coupler cover for covering said coupler, the coupler cover having a rear end, said rear end of said coupler cover being supported by said rubber dampered bearing body.

8. The drive shaft support structure for a small watercraft as set forth in claim 7, wherein a front portion of the coupler cover is fixed to the engine, and a rear end of the coupler cover is supported by the rubber dampered bearing body.

9. A drive shaft support structure for a small watercraft having a boat body, comprising:

a drive shaft for driving an impeller, the drive shaft being connected to an output shaft of an engine mounted in the boat body;

a cylindrical portion of a joint rubber through which said drive shaft is passed, said cylindrical portion of the joint rubber extending in a forward direction from an outside of said boat body toward said engine, the joint rubber being fitted to the boat body with an adhesive;

a rubber dampered bearing body rotatably supporting said drive shaft on the engine side so that said drive shaft does not contact said cylindrical portion of the joint rubber; said rubber dampered bearing body being supported by a support portion;

said rubber dampered bearing body having a rubber cylindrical portion and a rubber damper portion provided integrally with said rubber cylindrical portion, said rubber cylindrical portion extending toward said cylindrical portion of the joint rubber, and said rubber cylindrical portion and said cylindrical portion of the joint rubber being connected directly to each other by means of a ring-shaped clamp.

10. The drive shaft support structure for a small watercraft as set forth in claim 9, said rubber dampered bearing body further comprising:

a plurality of bearings in the rubber damper portion;

a first seal member mounted on a side of the bearings facing the engine; and a second seal member mounted on a side of the bearings facing the impeller.

11. The drive shaft support structure for a small watercraft as set forth in claim 9, wherein said rubber cylindrical portion is provided with a grease supply hole for supplying grease to a water seal portion of said rubber dampered bearing body, and a grease supply hose is connected to said grease supply hole.

12. The drive shaft support structure for a small watercraft as set forth in claim 11, wherein the grease supply hole is disposed on a front side of a flange portion of said rubber cylindrical portion.

13. The drive shaft support structure for a small watercraft as set forth in claim 11, wherein the grease supply hole is disposed on a rear side of a flange portion of said rubber cylindrical portion.

14. The drive shaft support structure for a small watercraft as set forth in claim 9, further comprising:

a coupler for connecting said output shaft of said engine and said drive shaft; and a coupler cover for covering said coupler, the coupler cover having a rear end, said rear end of said coupler cover being supported by said rubber dampered bearing body.

15. The drive shaft support structure for a small watercraft as set forth in claim 14, wherein a front portion of the coupler cover is fixed to the engine, and a rear end of the coupler cover is supported by the rubber dampered bearing body.

16. A drive shaft support structure for a small watercraft having a boat body, comprising:

a drive shaft for driving an impeller, the drive shaft being connected to an output shaft of an engine mounted in the boat body;

a cylindrical portion of a joint rubber through which said drive shaft is passed, said cylindrical portion of the joint rubber extending in a forward direction from an outside of said boat body toward said engine;

a rubber dampered bearing body rotatably supporting said drive shaft on the engine side so that said drive shaft does not contact said cylindrical portion of the joint rubber; said rubber dampered bearing body being supported by a support portion;

said rubber dampered bearing body including a rubber cylindrical portion and a rubber damper portion provided integrally with said rubber cylindrical portion;

said rubber cylindrical portion being provided with a grease supply hole for supplying grease to a water seal portion of said rubber dampered bearing body, a grease supply hose being connected to said grease supply hole, said rubber cylindrical portion extending toward said cylindrical portion of the joint rubber, and said rubber cylindrical portion and said cylindrical portion of the joint rubber being connected directly to each other.

17. The drive shaft support structure for a small watercraft as set forth in claim 16, wherein a rear end of the rubber cylindrical portion is connected by a ring-shaped clamp to the cylindrical portion of the joint rubber, the joint rubber being fitted to the boat body with an adhesive.

18. The drive shaft support structure for a small watercraft as set forth in claim 16, further comprising:

a coupler for connecting said output shaft of said engine and said drive shaft; and a coupler cover for covering said coupler, the coupler cover having a rear end, said rear end of said coupler cover being supported by said rubber dampered bearing body.

* * * * *